US011969026B2

(12) United States Patent
Claytor

(10) Patent No.: US 11,969,026 B2
(45) Date of Patent: Apr. 30, 2024

(54) DEVICES AND METHODS FOR CLEANING GLASS SMOKING ACCESSORIES

(71) Applicant: Samuel W. Claytor, Rye, NH (US)

(72) Inventor: Samuel W. Claytor, Rye, NH (US)

( * ) Notice: Subject to any disclaimer, the term of this patent is extended or adjusted under 35 U.S.C. 154(b) by 326 days.

(21) Appl. No.: 17/008,517

(22) Filed: Aug. 31, 2020

(65) Prior Publication Data

US 2021/0112857 A1 Apr. 22, 2021

Related U.S. Application Data

(60) Provisional application No. 62/893,800, filed on Aug. 29, 2019.

(51) Int. Cl.
*A24F 9/06* (2006.01)
*A24F 9/08* (2006.01)

(52) U.S. Cl.
CPC . *A24F 9/06* (2013.01); *A24F 9/08* (2013.01)

(58) Field of Classification Search
CPC ..... A24F 9/06; A24F 9/08
USPC ..... 134/166 R
See application file for complete search history.

(56) References Cited

U.S. PATENT DOCUMENTS 607,530 A * 7/1898 Taylor ..... B65D 35/32 24/570
5,297,310 A * 3/1994 Cox ..... B08B 9/0436 15/106
2010/0234809 A1* 9/2010 Kenley ..... A61M 39/281 604/180

* cited by examiner

*Primary Examiner* — Tinsae B Ayalew
(74) *Attorney, Agent, or Firm* — Bonini IP Law, LLC; Frank J. Bonini, Jr.

(57) ABSTRACT

A cleaning system and cleaning devices and methods for cleaning smoking accessories, and in particular, glass smoking accessories, including a containment, which according to preferred embodiments, is configured as an elastomeric tube, and preferably a silicone tube that is designed to receive the smoking accessory therein. A smoking accessory is admitted to the tube with a cleaner or detergent being added or present in the tube. A closure is provided for closing the end of the silicone containment or tube. The tube is folded over onto itself when the accessory is within the tube. The clip preferably is applied to the tube end to maintain the sealing position of the tube, in order to contain the accessory as well as an cleaning solution therein. The accessory is cleaned by shaking the tube with the accessory therein. A kit is provided having a tube, a brush and a clip.

9 Claims, 4 Drawing Sheets

Fig. 5
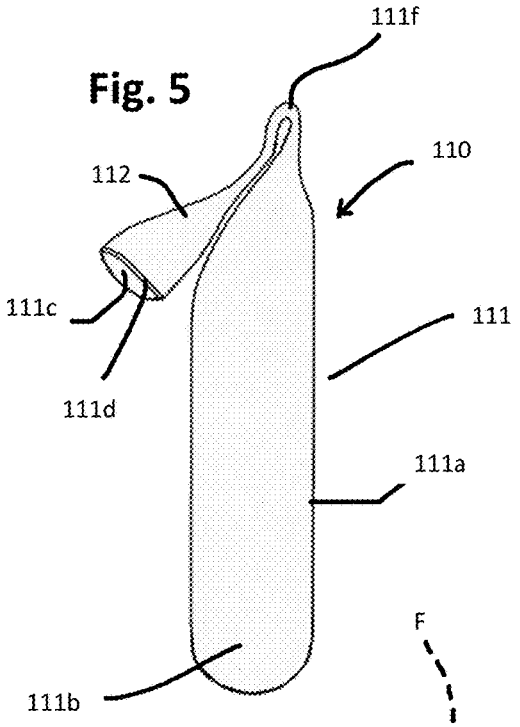
Fig.6
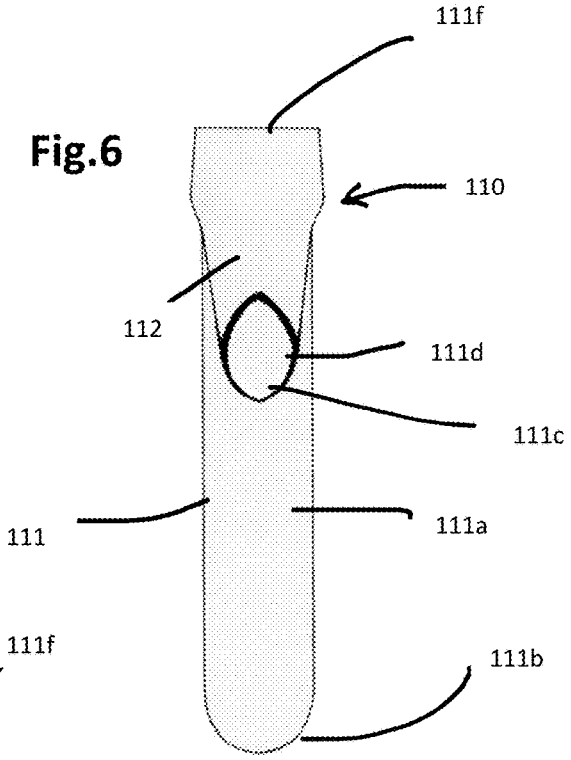
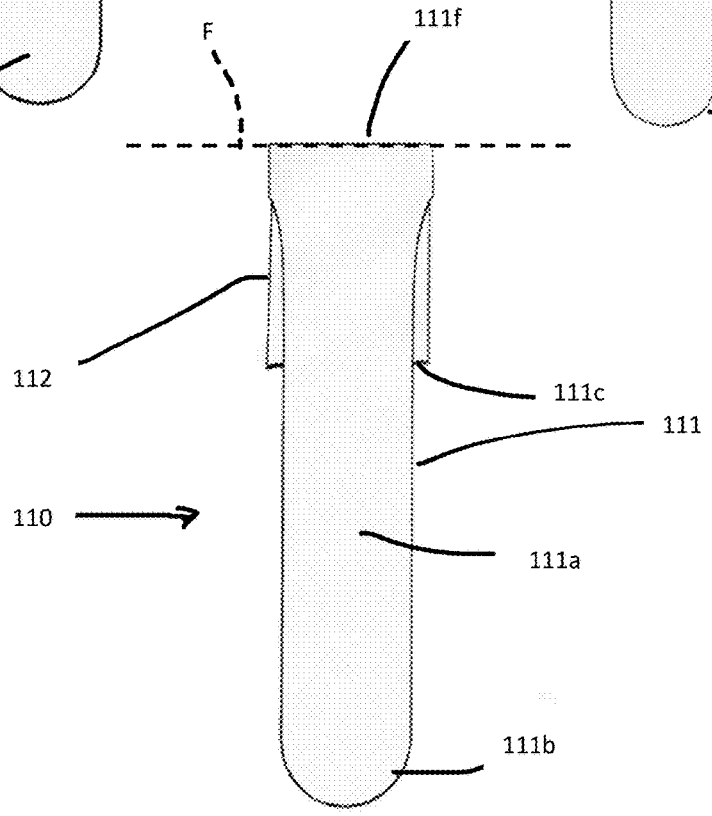
Fig. 7

DEVICES AND METHODS FOR CLEANING GLASS SMOKING ACCESSORIES

CROSS-REFERENCE TO RELATED APPLICATIONS

This application claims priority to U.S. provisional patent application No. 62/893,800, filed on Aug. 29, 2019, the complete contents of which is herein incorporated by reference.

BACKGROUND OF THE INVENTION

1. Field of the Invention

The present invention relates to the field of cleaning glass smoking accessories and more particularly to devices and methods for cleaning glass down stems and accessories such as glass bowls, slides, carb caps, concentrate nails and other smoking accessory tools.

2. Brief Description of the Related Art

Smoking from glass water pipes has become increasingly popular and has replaced other methods of inhalation such as rolled paper, tobacco cigarettes and dry pipes. There are establishments where individuals can go and purchase these water pipes and their accessories from a large array of glass artists. Glass water pipes function using accessories such as down stems and slides, which are typically made from borosilicate glass and metal. A down stem is a small glass or metal tube with a glass joint on one end a percolator on the other. The percolator end of the stem fits into the water pipes and is secured into position by the attached connecting joint. Through the percolator the water filters the smoke by removing some of the harmful toxins, which are produced by the combustion of dry materials. The glass connector joint of the down stem is designed to hold a glass slide which is the accessory which you place your dry material into.

When used, these glass smoking accessories become covered with a sticky resinous film. The film, if left on the glass surface and in the water, may harbor bacteria, molds, fungi and other particulates. If left uncleaned, these organisms remain, and can lead to bad odors, tastes, and detrimental health effects.

Currently, these accessories are cleaned in one's kitchen or bathroom, where a sink and running water is accessible. This process is achieved by using a disposable plastic bag and a cleaning solution, such as isopropyl alcohol. The plastic bag is opened, and cleaning solution is poured in, then your glass accessory is added. The bag is closed and shaken aggressively until the solution has stripped the tar/resin from the accessories. The accessories are then rinsed with water, and the plastic bag is disposed of.

Because of the nature of cleaning the smoking accessories they are left contaminated and not typically cleaned between uses, since cleaning is difficult and time consuming. For example, the fragile glass from which the accessories are made, often may break when one attempts to clean the devices, so instead, the option is to leave the device alone, and use it uncleaned. In many cases, some users will not clean their pipe accessories for over a year or two or not at all, due to the barriers presented.

A need exists for a device or devices and methods that provide an easier and more reusable way to clean glass smoking accessories, as well as a safe method that minimizes risks to the user.

SUMMARY OF THE INVENTION

A cleaning system and cleaning devices and methods for cleaning smoking accessories, and in particular, glass smoking accessories are provided. According to preferred embodiments, a silicone structure comprising a containment, which according to preferred embodiments, is configured as an elastomeric tube, and preferably a silicone tube. The tube preferably is designed to receive the smoking accessory therein. A smoking accessory is admitted to the tube with a cleaner or detergent being added or present in the tube. A closure is provided for closing the end of the silicone containment or tube. Preferably, the tube is configured so that its length is longer than the accessory to be cleaned so as to provide a suitable extension of the tube that permits the tube to be folded over onto itself when the accessory is within the tube. The clip preferably is applied to the tube end to maintain the sealing position of the tube, in order to contain the accessory as well as a cleaning solution therein. Due to the nature of the material in use, a strong air-tight seal is formed preventing any liquid from leaking out during use.

According to preferred embodiments, the method involves placing the accessory into the tube with a suitable detergent or cleaner, folding over the tube end, and installing the clip onto the tube. Then the tube with the accessory within the tube and in contact with the cleaner (also the tube) is shaken to remove the film and other residue that may be on the accessory.

According to preferred embodiments, the system may comprise a kit. One preferred exemplary embodiment of a kit includes a tube, a brush, and a clip. According to some other embodiments, a cleaner also may be provided as part of the kit. A container that holds the kit components may also be provided for ease of storage or transport of the components.

According to some preferred embodiments, the invention may comprise a silicone glass cleaner, which may be furnished in a kit that includes the tube itself, a clip, and a brush.

According to exemplary embodiments, the tube is provided with suitable dimensions to contain the accessory therein and also so that the tube end may be sealed over to prevent leakage of any cleaning liquid out of the tube during the cleaning process (e.g., shaking of the tube).

According to one exemplary embodiment, the cleaning device that is suitable for cleaning an accessory that is up to about 12 inches in length comprises a tube having a length that is about 14 inches long and an interior diameter of about 1.76 inches. The tube is designed to be filled with a cleaning solution, and then the accessory that is to be cleaned can be put in the tube. The tube is folded above the object being cleaned and secured with the provided clip. With the tube end secured, preferably with the clip installed thereon, the cleaning process continues. A user, preferably, then holding the tube containing the accessory with two hands, shakes the tube vigorously until the accessory is clean (i.e., the residue has been removed). The clip is then removed, and the accessory is then slid out into one's hand while over a sink, allowing the cleaning solution to drain out into the sink. The accessory may be detailed using the provided brush (when the components are supplied in the kit form). The brush has been designed to be sufficiently long enough to clean a variety of lengths of stems, while the diameter of the bristles has been made wide enough to clean most common joints of the accessories to be cleaned, such as for example an 18 mm female connection joint (the largest common joint size). The tube also is cleaned after each use and may be reused for additional cleaning cycles. To clean the tube, one may use the same cleaning solution, and fold the tube near the top and secure it with the clip. The sealed off tube may be shaken to remove or dislodge any residue or debris from the prior cleaning steps. One may simply shake the tube and cleaning solution therein, e.g., for about 10-20 seconds, then rinse with water and air dry. The brush may be cleaned quickly using the same method used for cleaning down stems.

Some features of the system and components include:

The tube is silicone, so the resin/tar does not easily stick to the tube and makes for very easy cleaning and maintenance.

The length of the cleaner allows for a wide variety of down stem lengths, and joint connection sizes.

Due to the thickness of the tube, when folded a natural seal is created by the silicone preventing cleaning solution from escaping during use.

An important feature of the device referred to (which may be provided under the registered mark StemClenz®) is that the material is strong enough to not tear but forgiving enough not to damage fragile glass. Preferred compositions for the present containment include silicone and silicone-based compositions, which are both suitably strong and resilient, and are inert to the cleaners and the residue being removed from the smoking accessories that are being cleaned.

A benefit and feature of the present cleaning system (the StemClenz® system) includes trying to decrease the large number of single use plastic bags that are being discarded due to them being used for this purpose. Approximately 500 billion plastic bags are used annually, which according to the United Nations Environmental Program, "Single-Use plastics, often referred to as disposable plastics, are commonly used for packaging and include items intended to be used only once before being thrown away or recycled . . . . Nearly 50% of the plastic waste generated globally in 2015 was plastic packaging". Of this, Annually, "8 million metric tons of plastic enter our oceans" (Theoceanconservancy.org).

Another benefit of the inventive cleaning system and components provided relates to health reasons and concerns. Using a dirty water pipe can cause a myriad of health problems. According to LiveScience.Com, "Biofilms are a collective of one or more types of microorganisms that can grow on many different surfaces. Microorganisms that form biofilms include bacteria". Bacteria which can produce such things as:

*Streptococcus*

*Escherichia coli* (*E. coli*)

*Pseudomonas aeruginosa*

Black mold

Because these can develop after only 48 hours it is very important to regularly clean one's glass water pipes and accessories.

While the kit (or StemClenz® kit) has particular utility for cleaning glass down stems, it also is a very versatile tool. It can be used to clean a variety of glass slides and bowls. These slides and bowls are typically cleaned with cleaning solution and Q-Tips. This is a tedious process which is time consuming and tiring. Instead, one can use the StemClenz® methods and devices shown and described herein, in a similar manner to how one would clean a down stem using the inventive methods and devices herein, except fold the tube much lower.

The kit can also be used for cleaning accessories used to smoke concentrates, such as carb caps, glass and quartz nails, and dab tools.

BRIEF DESCRIPTION OF THE DRAWING FIGURES

FIG. 5 is a left side elevation view of the tube of FIG. 1 shown in a folded condition.

FIG. 6 is a front elevation view of the tube in the folded condition shown in FIG. 5.

FIG. 7 is a rear elevation view of the tube in the folded condition shown in FIG. 5.

DETAILED DESCRIPTION OF THE INVENTION

An example of a cleaning system is shown in the figures. The cleaning system according to a preferred embodiment, includes components that may be provided together as a kit for cleaning glass smoking accessories.

Referring to FIGS. 1 to 4, a tube 110 is shown comprising a walled structure having a wall 111 which forms a side wall 111*a* and a bottom 111*b*. The tube 110 is shown open with an opening 111*c* on one end thereof (see FIGS. 1 and 8). In the preferred embodiment, the elastomeric walled tube 110, with the elastomeric bottom, provides a cushion for the glass smoking accessories therein placed for cleaning, and during the cleaning process. The elastomeric wall 111*a* and bottom 111*b* provide shock absorbing capabilities to promote safety for the user as well as minimizing or preventing breakage of the glass smoking accessory. In the event that a smoking accessory should break, or perhaps is already fractured but unnoticed prior to a user placing the glass accessory into the tube 110, the elastomeric tube provides protection against sharp glass fractions or shards passing through the wall 111*a* and bottom 111*b*. The elastomeric tube 110 is configured in an elongated shape to facilitate sealing and to preferably to receive and hold an accessory in an orientation to prevent movement that would subject the accessory to potential breakage. At the same time, the cleaning process carried out to clean the accessory placed within the tube may involve vigorous shaking, as the silicone tube provides a durable and sealing environment to seal the glass smoking accessory and cleaner, typically a solution, therein, and prevent undesired leakage of the cleaner and removed residues.

The tube 110 preferably comprises an elastomeric tube that is inert to materials, including cleaners used to clean the smoking accessory, and contaminants, such as the smoking residues, that the cleaners dissolve or otherwise remove from the glass smoking accessory. The elastomeric tube 110 preferably is flexibly constructed to form a seal 111*f* when folded over, as shown for example, in the folded condition represented in FIG. 5. The elastomeric tube material is self-sealing and forms the seal to prevent leakage of cleaners and residues that may reside within the tube during the cleaning process of cleaning a glass smoking accessory. The seal is releasable, so that when the cleaning has been accomplished, or if the user desires to check the effectiveness of the cleaning of the accessory, the folded condition may be restored to the open tube condition (see FIGS. 1 and 8). The tube 110 may be resealed using the self-sealing of the tube, by returning the tube to a folded condition (FIG. 5).

Figure 1:
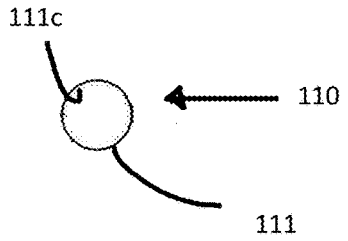
FIG. 1 is a top plan view of a tube for receiving glass smoking accessories therein for cleaning.
Figure 2:
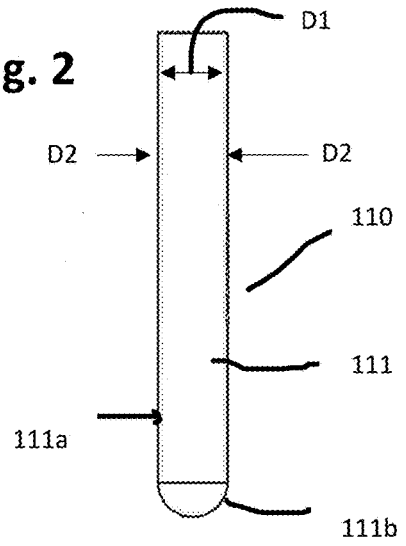
FIG. 2 is a front elevation view of the tube of FIG. 1.
Figure 3:
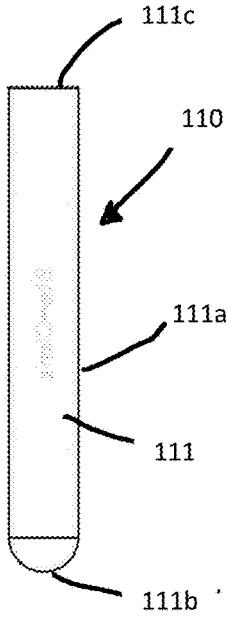
FIG. 3 is a rear elevation view of the tube of FIG. 2.

Referring to FIGS. 2 and 3, the exemplary tube 110 is shown having a suitable length and dimensions to clean a glass smoking accessory. In the exemplary embodiment, the silicone tube 110 at full extension, shown in FIGS. 2 and 3, may be about is about 335.6 mm in length. The tube 110 has a suitable diameter for allowing it to receive glass smoking accessories therein, and according to some preferred embodiments, the tube interior diameter may be about 3 to 6 cm, and more preferably about 4 to 5 cm. According to a particularly preferred embodiment a tube may have an exterior diameter of about 50.8 mm, and an interior diameter of about 44.8 mm. This is one preferred embodiment, and the tube may be configured having alternate dimensions.

Embodiments of the tube 110 preferably have a wall thickness suitable to provide protection for the accessory and the user using it, as well as providing the self-sealing capability by allowing the tube 110 to be folded over onto itself to seal the opening. The wall thickness 111*d* (see FIG. 8) according to preferred embodiments is about 4 to 8 mm, and more preferably is about 6 mm. The wall thickness preferably may correspond with the silicone composition comprising the tube, and for example, according to a preferred embodiment, a diameter of about 6 mm may correspond with a tube material durometer of about 30 AA Shore hardness, and preferably embodiments of the tube 110 may be made of 30 Shore AA silicone. According to a particularly preferred embodiment, the tube 110 is constructed of a silicone material having a 30 Shore AA durometer, with a wall thickness of about 6 mm, where the inner diameter D1 of the tube elongated section is about 44.8 mm, and the exterior diameter D2 is about 50.8 mm. According to a preferred embodiment the ratio of the tube thickness to the length of the tube 110, is about 1:60, and the ratio of the tube interior diameter to the length is about 1:8.

The folded portion 112 preferably is folded at a distance away from the opening 111*c* to promote a seal at the upper portion of the tube 110.

Figure 4:
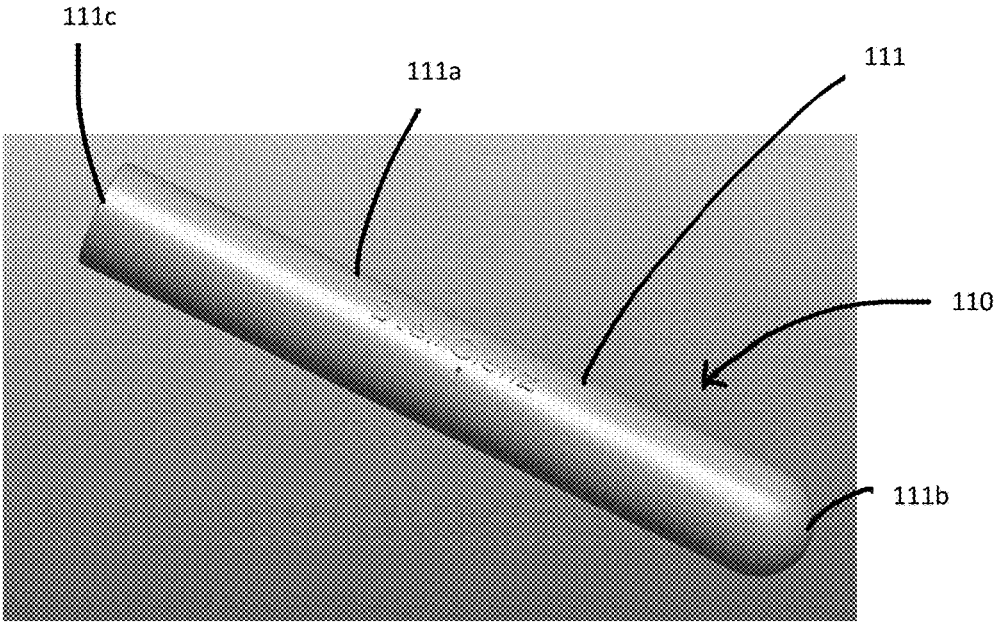
FIG. 4 is a horizontal perspective view of the tube of FIG. 2.

The tube 110 is depicted in a preferred configuration having a rounded bottom 111*b* as shown is FIG. 4, which prevents cleaning solution and sticky resin from getting stuck in any crevices. Similarly, according to preferred embodiments, the tube itself is a cylindrical shape to prevent this sticky resin or cleaning solution from getting stuck to the sides of the tube. According to preferred embodiments, the tube 110 as well as the tube wall 111 do not include edges or corners in order to prevent build-up of residue.

To further prevent resin from sticking to the sides of the tube, the tube preferably is made of an inert and flexible material. The material from which the tube is constructed may be a suitable inert material (that is resistant to reacting with the residue of the glass accessory being cleaned, and the cleaners used. Preferred materials from which the tube may be constructed include elastomeric materials that are flexible and suitably strong so the tube may be shaken when the glass accessory is present in the tube, without rupturing the tube wall 111. Some preferred materials include elastomers, including synthetic rubber, silicone, silicone rubber, silicone containing elastomers, and the like. According to preferred embodiments, the tube may be made of silicone or silicone based material, as shown in FIGS. 2 and 3, providing a surface that the resin or residue does not adhere too. Some examples of silicone containing materials include polydimethylsiloxane (PDMS) or PDMS based compositions.

As shown in FIGS. 1-8, the containment device or tube 110 preferably has elastomeric properties and is flexible. The tube 110 may be constructed from a suitable material that, according to preferred embodiments, has a Shore hardness that permits the tube to be flexible and fold over on itself. According to some preferred embodiments, the tube may be constructed from a material having a 30 AA Shore hardness, and preferably embodiments may be made of 30 Shore AA silicone. This is one preferred durometer, and the tube 110 may be configured having alternate durometers that are suitable for the uses described herein, which allows for the tube 110 to be easily folded, as shown in the folded conditions represented by FIGS. 5-7. The soft silicone creates a natural seal when folded, which is crucial for keeping any of the cleaning solution from coming out during use.

The tube 110 as shown in FIGS. 3 and 4, may be constructed of a material that includes markings or other indicia thereon, which according to preferred embodiments, may be molded in the tube material when formed or produced. In the exemplary depiction in FIG. 4, the tube 110 is shown with the outer surface 111*g* of the tube wall 111 having embossed lettering of "StemClenz", which is a brand name and registered trademark.

Figure 9:
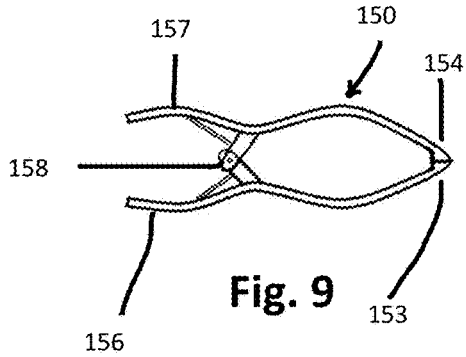
FIG. 9 is a side elevation view of a clip.
Figure 10:
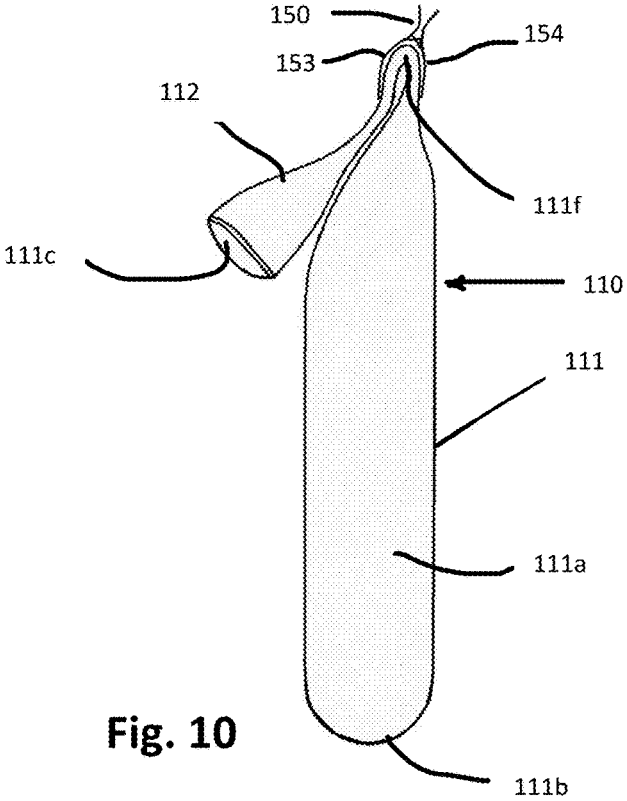
FIG. 10 is a left side elevation view of the tube folded as shown in FIG. 5, with the clip of FIG. 9 installed thereon.

The tube 110 preferably is used with a clip, and according to preferred embodiments, the invention comprises a kit that includes the tube and a clip configured and sized to maintain the fold 111*f* shown in FIGS. 5-7, when the clip is installed on the folded tube 110, as shown in FIG. 10. The kit, also referred to as the StemClenz® kit, preferably includes a clip 150, which, for example, may be made from plastic or other suitable material. The clip is shown in FIG. 10 attached to the tube 110, and is shown in separate views in FIGS. 9 and 11. According to some preferred embodiments, the clip may be constructed from a durable plastic material, and may include a spring bias with a spring, coil, or other element. The clip 150 is shown in FIG. 9 having a pair of arms 151, 152 that each terminate into a respective engaging jaw 153, 154 at the clamping end 155. The clip 150 also has an operating end comprising two handles 156, 157 for a user to grasp. When the handles 156, 157 are moved toward each other, against the bias of the spring element 158, the jaws 153, 154 open and allow the clamping end 155 to be positioned on the folded tube end 112 as shown in FIG. 10. Once positioned on the folded tube end 112, the handles 156, 157 are released allowing the spring bias of the spring element 158 to move the jaws 153, 154 into clamping engagement with the folded over tube end, for example, as depicted in FIG. 10. The cleaner, such as a liquid solution, and glass accessory to be cleaned, preferably are loaded into the tube 110 prior to installing the clip 150. With the clip 150 in position on the tube 110 and the accessory and cleaner in the tube 110, the cleaning may be carried out by agitation, so that the tube and its contents are agitated by shaking or other movement. As shown in FIG. 10, the clip 150 may be used to secure the folded tube 110 during use. While the tube itself creates a strong seal, by using the clip 150 the user can use both hands to ensure they have a solid grip on the cleaner (e.g., the containment or tube).

The self-sealing tube wall 111 is foldable to create a folded portion 112 comprising a thickness of four times the thickness of the tube wall 111*b*. The clip 150 is configured to releasably secure the folded over tube portion 112 in the folded condition (as shown in FIG. 10) along the imaginary fold line F. The folded portion 112 is shown folded along an the imaginary fold line F at the axis of the fold. The clip clamping jaws 153, 154 are releasably openable to clamp the folded over tube portion 112 in the folded position at the imaginary fold line F, and the clip 150 clamping jaws 153, 154 are biased with the spring element 158 to maintain engagement by the clamping jaws 153, 154 to clamp the folded over tube 112 in the folded condition.

Figure 11:
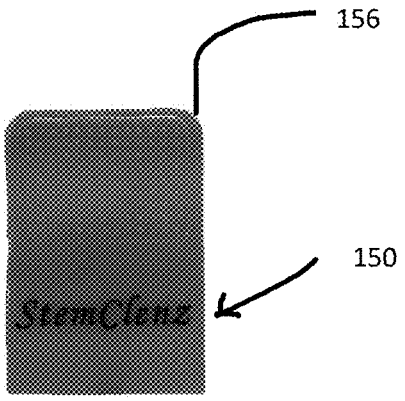
FIG. 11 is a perspective view of the clip of FIG. 9, as viewed from the front, with the clip in a vertical orientation.
Figure 12:
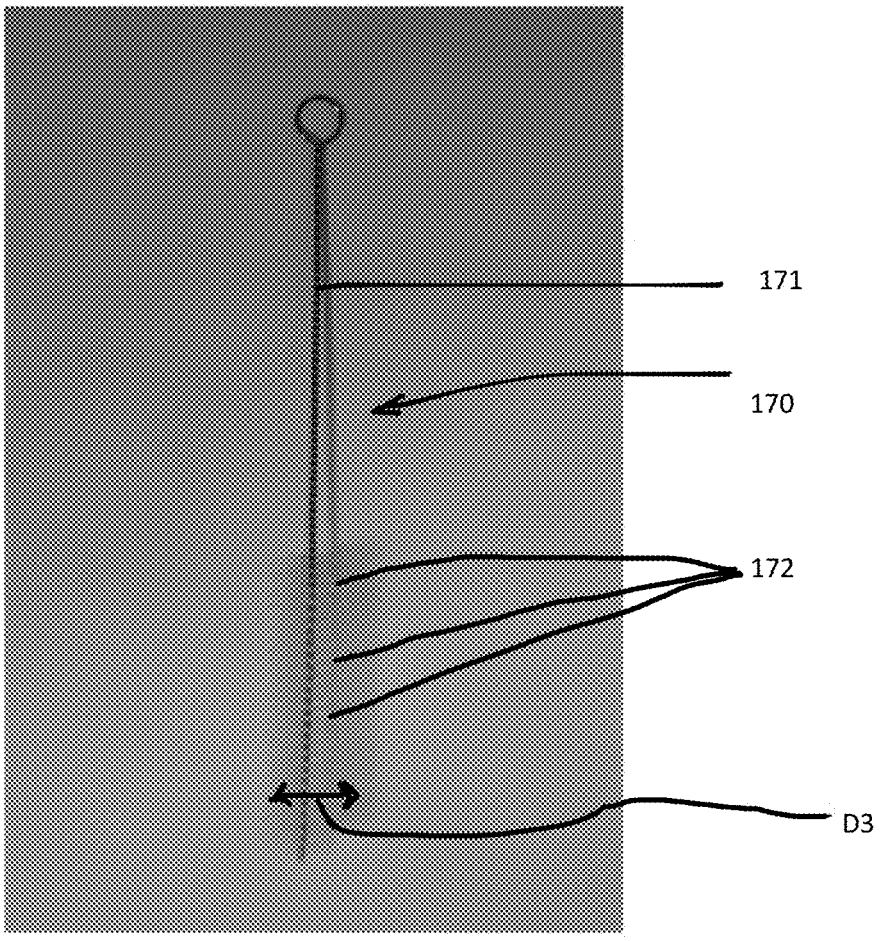
FIG. 12 is a front elevation view of a brush.

Preferably in addition to the tube 110 and clip 150, preferred embodiments of the kit also include a cleaning brush 170, which is shown in FIG. 11. The brush 170 is designed to perform the fine detail and finish cleaning of the glass accessory, such as glass down stems, but is also very effective for all types of glass accessories. The brush design is configured to have a sufficient length that is long enough to clean a variety of lengths of stems. The brush 170 is shown having a stem 171, with a plurality of bristles 172 at the cleaning end 171*a*. According to some preferred embodiments, the brush 170 is configured to have bristles 172 that have a diameter D3 suitable to clean the glass accessory. According to some preferred embodiments, the brush bristles 172 has a diameter sufficient for cleaning the largest sizes of a glass accessory joint. According to some embodiments, the diameter of the bristles 170 may be wide enough to clean 18 mm female joints (the largest common joint size).

The present components preferably may be used to carry out a preferred cleaning method. An exemplary cleaning method, which includes the following steps, is set forth below:

Method

Figure 8:
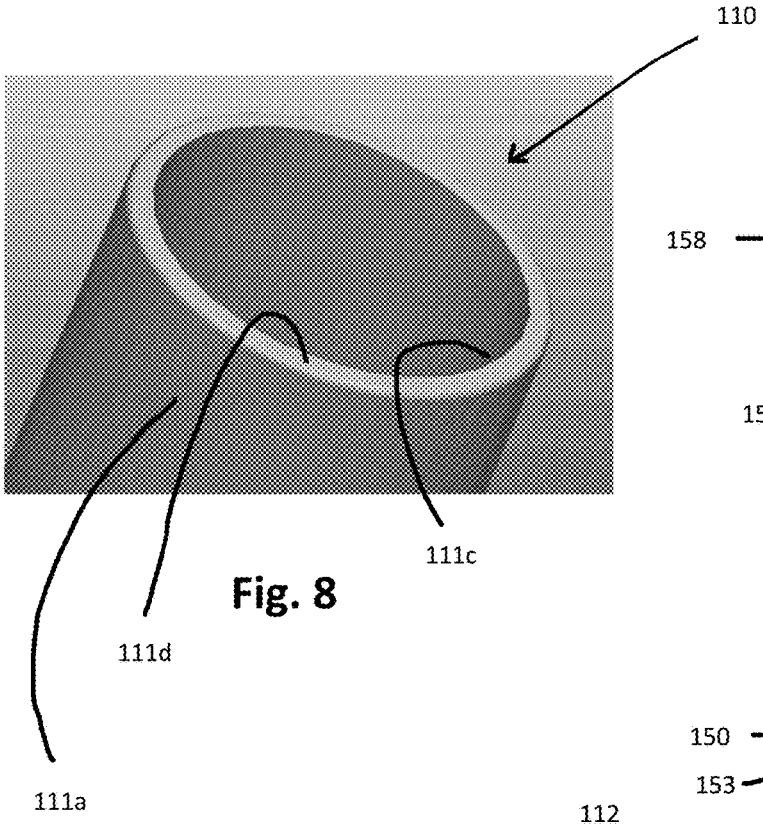
FIG. 8 is a perspective view of the top portion of the tube shown in an open condition.

Step 1: Begin by pouring a cleaning solution into the opening 111*c* of the tube 110 as shown in FIG. 8 (using either a two-part solution or a one part, both of which are commercially available).

Step 2: Take the accessory that is to be cleaned and place it into the opening 111*c* of the tube 110 as shown in FIG. 8.

Step 3: The tube 110 is to be folded above the accessory that is being cleaned, the folded condition being shown in FIGS. 5, 6 and 7.

Step 4: The tube 110 when folded over, is then secured with the provided clip 150 as shown in FIGS. 9 and 10.

Step 5: Holding with two hands, the tube 110 and contents (the glass accessory and cleaner) are shaken vigorously until the accessory is clean.

Step 6: The clip 150 is then removed, and the tube 110 is unfolded carefully.

Step 7: The accessory is then poured out into one's hand while held over a sink (or alternately a strainer may be used).

Step 8: The accessory can be detailed using the provided brush 170, as shown in FIG. 11, and some of the left-over or remaining cleaning solution from the tube 110.

Step 9: Rinse the now cleaned accessory with warm water, and dry.

Step 10: Repeat the process until desired results are achieved.

Step 11: To clean the tube 110, use the same cleaning solution as used for the accessory, fold the tube 110 near the top and secure with the clip 150. Simply shake for 10-20 seconds, then rinse with water and air dry.

Step 12: The brush 170 can be cleaned quickly using the same method used for cleaning down stems.

What is claimed is:

1. A device for cleaning glass smoking accessories, such as down stems, slides, and glass concentrate accessories, the device comprising:

a tubular structure having an interior cylindrical space and being dimensioned to hold glass smoking accessories, such as down stems, slides, and glass concentrate accessories therein, the dimensioned tubular structure being an elongated structure; the tubular structure being made from a pliable material that is inert to the smoking residue;

the tubular structure comprising a wall, the wall having a rounded bottom end defining a lower boundary of the device that comprises a bottom wall that closes the tube at the bottom end, and the wall having a top edge defining an upper boundary of the device, the wall forming at the end opposite the rounded end, an opening defined by the wall top edge;

wherein the wall comprises an interior surface comprising a vertical interior surface and a rounded interior surface, the vertical interior surface joining the rounded interior surface; and wherein the wall is a continuous wall;

wherein said tubular structure has a wall defining an interior space therein, and wherein said wall is foldable to releasably seal off the interior space of the tube, against the passage of liquids out from the tube interior space;

wherein said tube wall comprises an elongated portion and a rounded end forming a bottom, wherein said tube wall terminates at the top of said tube to form an opening, said opening being located opposite said rounded end forming the tube bottom, and wherein the tube wall defining said interior space does not include any edges;

including a clip applied to said tube open end to releasably seal the opening, and wherein said wall comprises a self-sealing wall that is foldable to create a folded portion comprising a thickness of four times the thickness of the tube wall, and wherein said clip is configured to releasably attach to the exterior of the folded wall and to releasably secure the folded over tube portion in the folded condition, wherein said folded portion comprises an imaginary fold line at the axis of the fold, wherein said clip includes a pair of clamping jaws that are releasably openable to clamp the folded over tube portion at the imaginary fold line into a clamped position, and wherein the clamping jaws are biased with a spring element to maintain engagement by the clamping jaws to clamp the folded over tube in the folded condition, the clamping jaws engaging the fold of the folded over tube wall at the imaginary fold line, and wherein when the clip is positioned on the tube, the clip when in the clamped position, surrounds the outer perimeter of the fold.

2. The device of claim 1, wherein the tubular structure is self-sealing to form a releasable seal against the passage of liquids from the tube when the wall is folded over onto itself; and wherein said self-sealing is reversable to unseal the seal formed by unfolding the tube wall, wherein the tube wall, when folded over onto itself, forms a sealed boundary at the tube end opposite the rounded end.

3. The device of claim 1 wherein the pliable material comprises silicone.

4. The device of claim 3, wherein the silicone has a durometer of 30 AA.

5. The device of claim 1, wherein said tube wall has a thickness of from 3 to 7 mm.

6. The device of claim 1, wherein said tube wall has a thickness of 6 mm.

7. The device of claim 2, wherein the tube wall, when folded over onto itself, forms a sealed boundary at the tube end opposite the rounded end.

8. The device of claim 1, wherein said tube wall and said top edge defining the upper boundary of the device have a uniform diameter.

9. A kit for cleaning a glass smoking accessories, such as down stems, slides, and glass concentrate accessories, the device comprising:

a) the device of claim 1, and;

b) a brush.

* * * * *